United States Patent [19]

Davy

[11] 3,960,102

[45] June 1, 1976

[54] TRIMARANS

[76] Inventor: Duncan Clement Davy, Spey House, Mayfield, East Sussex, England

[22] Filed: June 24, 1975

[21] Appl. No.: 589,848

[30] Foreign Application Priority Data

July 8, 1974 United Kingdom ..... 30123/74

[52] U.S. Cl. ..... 114/123; 114/61

[51] Int. Cl.[2] ..... B63B 43/14

[58] Field of Search ..... 114/61, 66.5 F, 122, 114/123, 126; 9/1 R, 1 D

[56] References Cited

UNITED STATES PATENTS

| | | | |
|---|---|---|---|
| 1,710,625 | 4/1929 | Kapigian | 114/123 |
| 3,276,413 | 10/1966 | Dolph et al. | 114/123 |
| 3,629,884 | 12/1971 | Brown | 114/61 |

*Primary Examiner*—Trygve M. Blix
*Assistant Examiner*—Jesus D. Sotelo
*Attorney, Agent, or Firm*—Holman & Stern

[57] ABSTRACT

A trimaran has a central hull, a pair of floats and outriggers for supporting the floats on each side of the central hull, and inboard supports from which the floats can be suspended in an inboard position. The outriggers are pivotally mounted, about substantially vertical axes, on the central hull, so that the floats can be moved bodily along track surfaces defined by the outriggers until the floats are supported from the inboard supports. The outriggers can then be pivoted so that they are positioned alongside the central hull. The arrangement allows easy overland transportation of the trimaran on a trailer.

9 Claims, 9 Drawing Figures

28
29a
21
22
26
24
23
4
35
34
27
25
65
60
1

35
27
31a
32
30a
34
33
2a
2
30
31

45
29a
46
43
28
41
29
42
43
34
35
27
44

TRIMARANS

BACKGROUND TO THE INVENTION

This invention relates to trimarans, and relates to trimarans having a central hull and a pair of floats mounted on outriggers, on each side of the central hull.

A trimaran has a much larger beam than a conventional boat, and at times this can be a disadvantage, for example, if it should be desired to transport the trimaran overland on a trailer. Also, most canals are too narrow to accommodate a trimaran, and some marinas make higher berthing charges for a trimaran because of the extra space it occupies compared with a conventional craft.

SUMMARY OF THE INVENTION

According to the present invention, a trimaran has a pair of floats, outriggers for supporting the floats on each side of the central hull, and inboard supports from which the floats can be suspended in an inboard position, the outriggers being pivotally mounted on the central hull, so that the floats can be moved bodily along the outriggers until they are supported from the inboard supports and then the outriggers can be pivoted so that they are positioned alongside the central hull.

Each outrigger may comprise a lower member which serves as a track for a co-operating part of a respective float, and bearing means, for example roller bearings, or low-friction bearing surfaces made of a plastics material such as polytetrafluoroethylene or nylon. The lower members may be of inverted T-shaped cross-section, or of box section.

Means may be provided for pivoting the outriggers upwardly from mooring positions to sailing positions.

There also may be provided bracing members for the outriggers when they are in the operative position. These bracing members may also serve as decking, and they may be hinged to facilitate the retraction of the floats.

An embodiment of the invention will now be described, by way of example, with reference to the accompanying drawings, wherein:

DETAILED DESCRIPTION OF THE INVENTION

Figure 1:
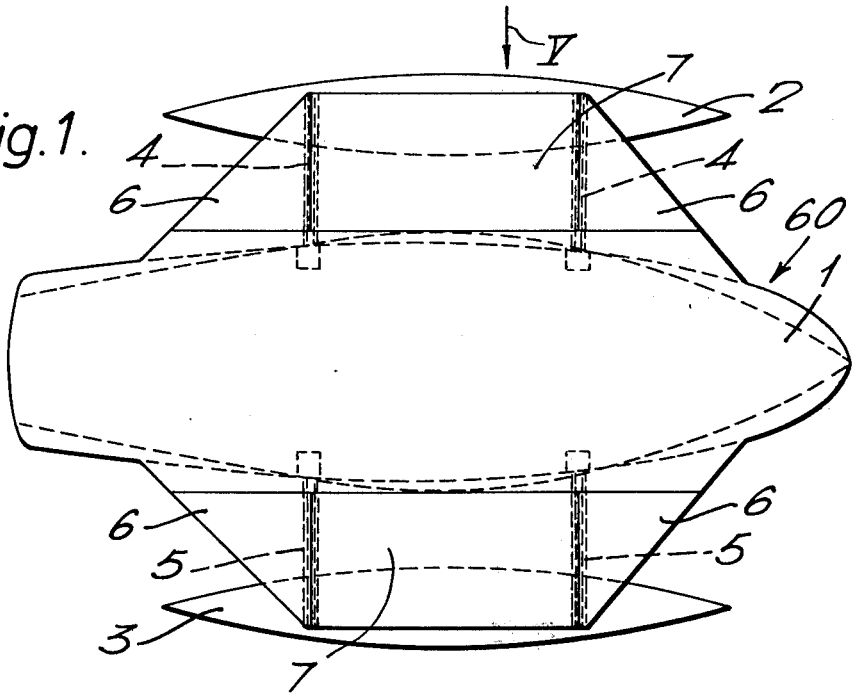
FIGS. 1 and 2 are schematic plan views of a trimaran with floats in the operative and retracted positions, respectively.
Figure 2:
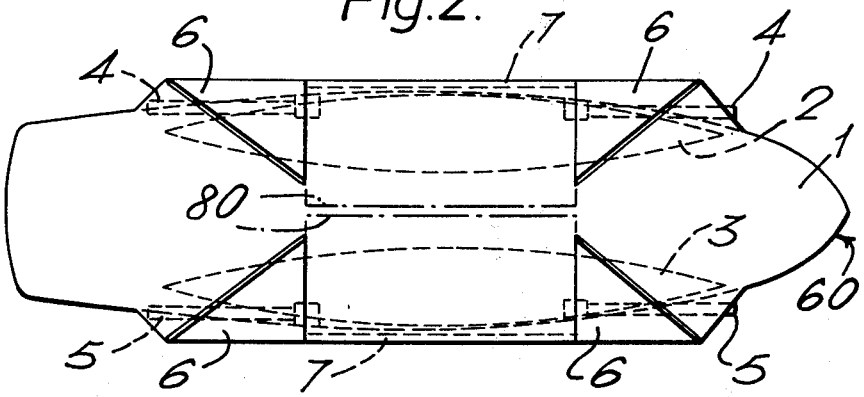
Figure 3:
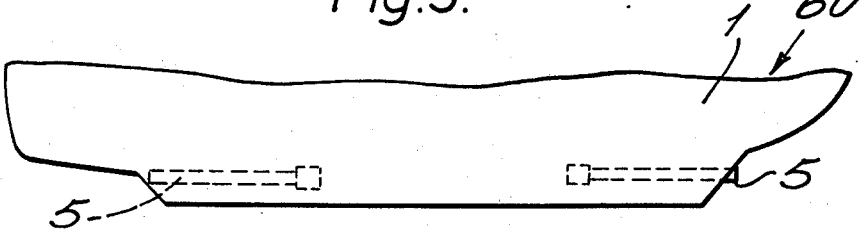
FIG. 3 is a fragmentary view similar to that of FIG. 2, but with parts removed for clarity.

Referring to FIGS. 1, 2 and 3, a trimaran comprises a central hull 1 and a pair of floats 2 and 3. The floats 2 and 3 are each mounted on a pair of outriggers 4 and 5, respectively, on each side of the hull. In their operative positions (see FIG. 1), the floats 2 and 3 are positioned at the outboard ends of their respective pair of fore and aft outriggers 4 and 5. The outriggers 4 and 5 are braced by four triangular braces 6 of triangular form and two braces 7 of rectangular form. The braces 6 and 7 are attached to the hull by hinges and can also serve as decking. If so desired, they could be replaced by an open framework. FIG. 2 shows the floats 2 and 3 in the retracted position with the forward outriggers 4 and 5 pivoted, (about upright axes), in a forwards direction until they are alongside the central hull 1, and the after outriggers 4 and 5, (also about upright axes), pivoted sternwards until they too are alongside the central hull 1. The triangular braces 6 are folded upwards, and the rectangular braces 7 are folded downwards outboard of the retracted floats 2 and 3, and within their hinge lines. FIG. 3 is similar to FIG. 2 but the braces 6 and 7 have been removed for clarity.

Figures 4, 5, 6:
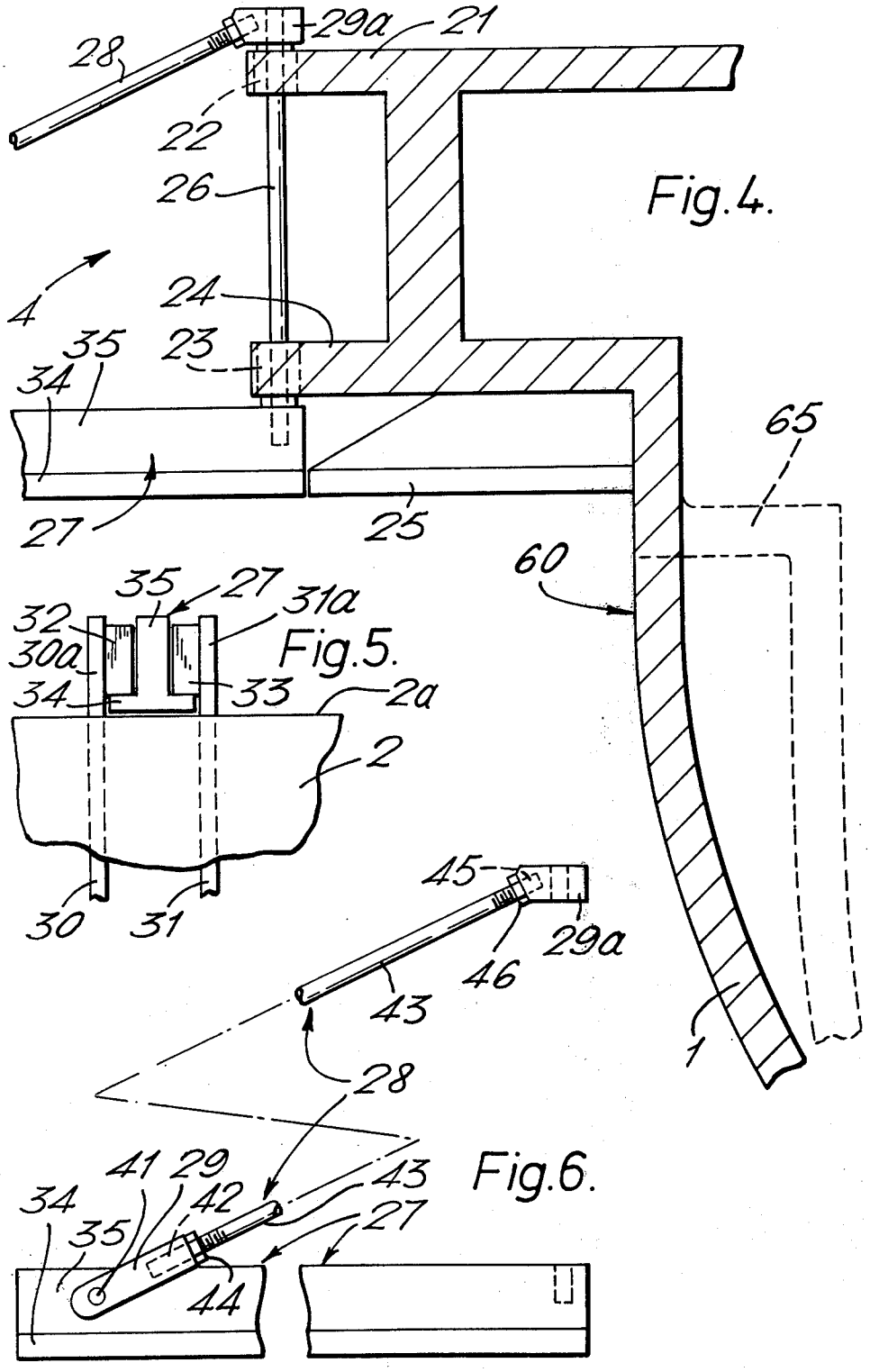
FIG. 4 is a fragmentary stern view, in cross-section, of part of the trimaran.
FIG. 5 is a fragmentary side view, showing part of a float and outrigger, viewed in the direction of the arrow V of FIG. 1.
FIG. 6 is a fragmentary side view of an outrigger.

Referring now to FIG. 4, which shows a portion of the central hull 1 and the inboard end of one of the outriggers 4, the central hull has at least a portion of its deck 21 overhanging to provide a mounting for an upper outrigger journal 22. A corresponding lower outrigger journal 23 is mounted in a projection 24 from the side of the central hull 1. Beneath the projection 24 is a fixed support 25 providing inboard support means for the float 2 (not shown). For strength the fixed inboard support 25 is attached to both the hull 1 and the projection 24. The cross-section of the fixed support is an inverted T member. The outrigger 4, which is shown in the Figure, is pivotally attached to the hull 1 by an upright hinge pin 26 which is rotatably located by the journals 22 and 23. The outrigger 4 has a horizontal lower member 27 which has a cross-section the same as that of the fixed support 25, i.e. of inverted T section. The lower member 27 serves as a track for track bearing means (described below) carried by the appropriate float 2, 3, so that the latter can move along the member 27 to or from the fixed support 25. The shape of the lower member also allows it to pivot about its upright axis which coincides with the axis of the hinge pin 26. With reference to FIG. 6 also, a tubular strut 28 is attached to the member 27 at its lower end by way of a lower end fitting 29 and at its upper end to a fitting **29*a* which is mounted on the upper end of the hinge pin 26. Thrust washers are interposed between the projections 22 and 24 and the inboard end of the member 27 and the upper end fitting 29*a* of the strut 28**.

If desired, the sides of the central hull 1 can be relieved above the water line to accommodate the floats 2 and 3 more effectively, as shown by the dotted lines 65 (FIG. 4), when the floats are in their retracted or inoperative positions.

Referring now to FIG. 5, two bulkheads 30, 31 which form part of the respective float 2 have projections **30*a* and 31*a* which extend above the upper surface 2*a* of the float 2. The separation of the projections 30*a* and 31*a* is such as to provide a working clearance for the member 27. Attached to the inner walls of the projections 30*a* and 31*a* are bearing means which co-operate with the member 27. The bearing means comprise blocks 32 and 33 of polytetrafluoroethylene. The bearing blocks 32 and 33 are of a size and shape such that they bear on both the flanges 34 and the central web 35 of the member 27 so that the float 2 can be moved bodily along the member 27. Other forms of anti-friction bearing means, for example rollers, can be used however, instead of the blocks 32, 33**. However, as the floats are not expected to be extended or retracted too often, friction is not a great problem.

With further reference to FIG. 6, the lower end fitting 29 is in the form of a clevis fork which is attached to the web 35 of the member 27 by a clevis pin 41. The lower end fitting 29 has an axial screw-threaded hole 42 into which the central part 43 of the strut 28 is screwed. It is locked in position by a lock nut 44. The upper end of the central part 43 of the strut 28 is screwed directly into a similar hole 45 in the upper end fitting 29*a*. A second lock nut 46 is provided. The screw threads are of opposite hands so that the effective length of the strut 28 can be adjusted. If desired, the upper end of the central part 43 of the strut 28 could be attached to the upper end fitting 29*a* via another clevis fork to reduce the stresses on the hinge pin 26. Provision for vertical adjustment is optional however and is not essential to the invention.

Figure 7:
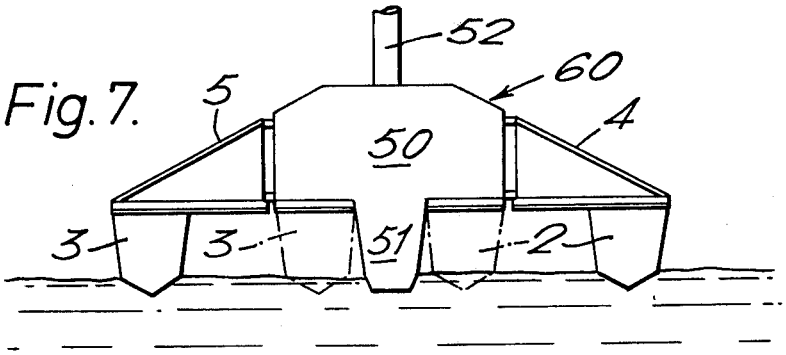
FIG. 7 is a sectional "bow-on" view of the trimaran.

FIG. 7 shows the trimaran 60 viewed bow-on, and in section, with the floats 2 and 3 shown by dotted lines in the nested or inoperative positions they assume when retracted. It will be noted that, when retracted, the floats 2 and 3 do not increase the fixed beam (width) of the trimaran at its largest dimension, which is between the fore and aft outriggers. FIG. 7 also shows the cabin (50) and hull (51) sections of the trimaran 60, also the mast (52).

Although only one outrigger and co-operating part of a float have been described in detail, it is to be understood that all four outriggers and co-operating parts of the floats are similar.

The outriggers 5 and 6 may be of "solid", i.e. "filled in" construction if desired.

In use, the floats 2 and 3 are moved bodily inwards and outwards by a system of tackles which are not illustrated as they are conventional in nature.

In an alternative arrangement which also is not illustrated, the hinge pin 26 is fixed in the projections 22 and 23 and journalled in the inboard end of the member 27 and the upper end fitting 29*a* of the strut 28.

Figure 8:
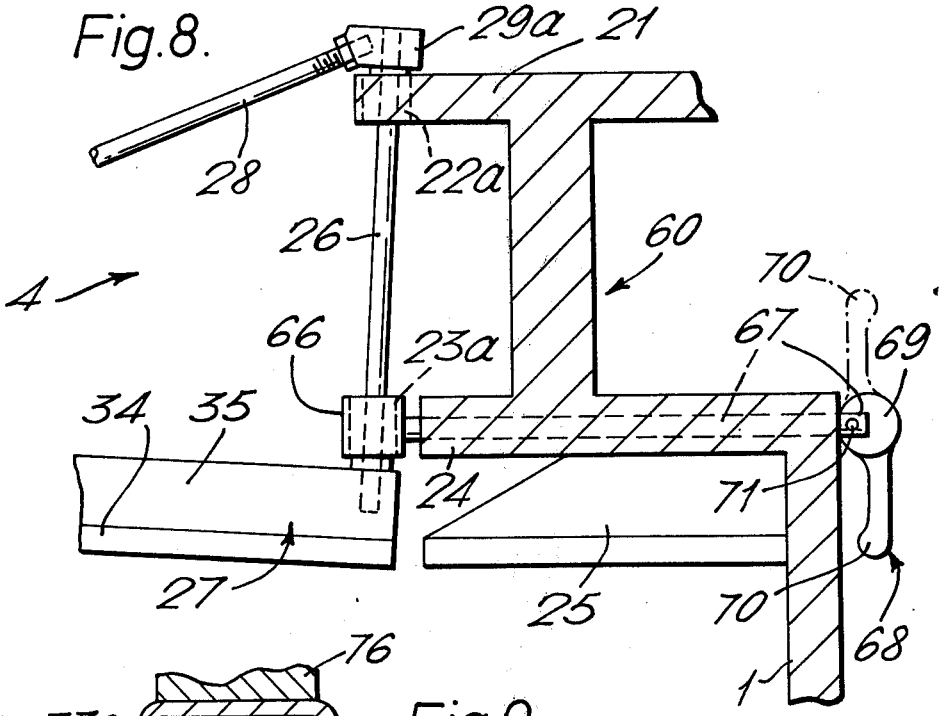
FIG. 8 is a view similar to FIG. 4 and illustrates one modification.

FIG. 8 illustrates a modification wherein the outriggers 4, (and similarly the outriggers 5) may be pivoted upwardly from lower, or mooring, positions to upper, or sailing positions.

In this modification, a hinge pin 26 is located by rubber bushes 22*a*, 23*a*, so as to allow lateral movement of the pin. The lower bush 23*a* is housed in a body 66 attached to the outboard end of an actuating rod 67 of rectangular cross-section, slideably located in a bore of the same cross-section, which is formed in the projection 24 of the hull 1. The inboard end of the actuating rod carries a toggle-actuator 68 comprising an eccentrically-mounted cam 69 rotatable, through 180°, by a handle 70. The cam 69 is rotatable against the adjacent (reactive) surface of the hull 1. To move the actuating rod 67 outwardly, the handle 70 is moved downwardly, as shown in full lines, whereby the rotational axis 71 of the cam 69 is moved outwardly. To move the actuating rod 67 inwardly, the handle 70 is moved upwardly, through 180°, to the position shown in the dotted lines, whereby the axis 71 is displaced inwardly. The handle 70 is lockable in either position.

By use of the modification illustrated in FIG. 8, a 2 inch axial movement of the rod 67 results in a rise and fall of about 7 inches of the floats 2, 3.

Figure 9:
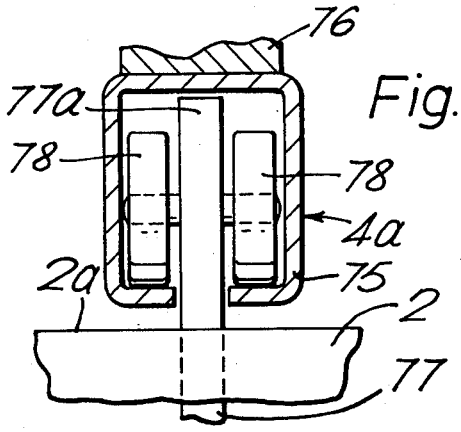
FIG. 9 is a view similar to FIG. 5 and illustrates another modification.

In the modification illustrated by FIG. 9, the inverted T member 27 (FIGS. 4, 5, 6 and 8) is replaced by a box member 75 which forms part of an outrigger 4*a*. The stay 28 of the original outrigger is replaced by a solid support member 76 of triangular form.

Each pair of bulkheads 30, 31, are here replaced by a single bulkhead 77, having an upwardly-extending extension 77*a* which carries bearing means in the form of pairs of rollers 78. The rollers 78 bear upon, and are thereby carried by, the lower parts of the box member 75. The box member 75 thus forms an enclosed track for the rollers 78 whereby the floats 2 and 3 can be moved bodily towards and away from the hull 1.

With reference to FIG. 2, in a further modification, the rectangular braces/deck sections 7 may be hinged upwardly, so as to rest upon the deck of the hull 1, as indicated by the chain-dotted lines 80.

I claim:

1. A trimaran having a central hull, a pair of floats, outriggers for supporting the floats on each side of the central hull, and inboard supports from which the floats can be suspended in an inboard position, the outriggers being pivotally mounted on the central hull, so that the floats can be moved bodily along the outriggers until they are supported from the inboard supports and then the outriggers can be pivoted so that they are positioned alongside the central hull.

2. A trimaran as claimed in claim 1, wherein each outrigger comprises a lower member which serves as a track for track bearing means carried by the float.

3. A trimaran as claimed in claim 1 provided with means for pivoting the outriggers upwardly from mooring positions to sailing positions.

4. A trimaran as claimed in claim 1 provided with members for bracing the outriggers when the latter are in their operative positions.

5. A trimaran as claimed in claim 4, wherein the bracing members also serve as decking.

6. A trimaran as claimed in claim 4, wherein the bracing members are hingedly attached to the central hull.

7. A trimaran as claimed in claim 1, wherein the central hull is recessed to accommodate the floats, when in their inoperative positions.

8. A trimaran as claimed in claim 2, wherein the lower member is of inverted T cross-section.

9. A trimaran as claimed in claim 2, wherein the lower member is of box cross-section.

* * * * *